US005568798A

United States Patent [19]

Lorraine

[11] Patent Number: 5,568,798

[45] Date of Patent: Oct. 29, 1996

[54] PLASTIC FUEL RAIL HAVING INTEGRATED ELECTRICAL WIRING

[75] Inventor: Jack R. Lorraine, Newport News, Va.

[73] Assignee: Siemens Automotive Corporation, Auburn Hills, Mich.

[21] Appl. No.: 488,670

[22] Filed: Jun. 8, 1995

[51] Int. Cl.[6] ..... F02M 41/00

[52] U.S. Cl. ..... 123/456

[58] Field of Search ..... 123/456, 468–9, 123/470

[56] References Cited

U.S. PATENT DOCUMENTS

| | | | |
|---|---|---|---|
| 4,950,171 | 8/1990 | Muzslay | 123/456 |
| 5,086,743 | 2/1992 | Hickey | 123/456 |
| 5,111,794 | 5/1992 | DeGrace, Jr. | 123/456 |
| 5,131,857 | 7/1992 | Gmelin et al. | 123/456 |
| 5,203,304 | 4/1993 | Hafner et al. | 123/456 |
| 5,209,204 | 5/1993 | Bodenhausen et al. | 123/456 |
| 5,211,149 | 5/1993 | DeGrace, Jr. | 123/456 |
| 5,226,391 | 7/1993 | Gras et al. | 123/456 |
| 5,295,468 | 3/1994 | Blessing et al. | 123/456 |
| 5,347,969 | 9/1994 | Gmelin et al. | 123/456 |
| 5,363,825 | 11/1994 | Becker | 123/456 |

*Primary Examiner*—Thomas N. Moulis
*Attorney, Agent, or Firm*—Russel C. Wells

[57] ABSTRACT

A fuel rail including an electrical strip is utilized to electrically couple fuel injectors to an external electrical connector situated on an outside surface of the fuel rail. The fuel rail is preferably made from plastic and includes injector cups situated in fuel injector attachments for mechanically receiving the fuel injectors. The fuel injectors are electrically and mechanically coupled to the fuel rail by an upward mechanical motion. The fuel injectors include clip-like electrical connectors which receive connector fingers of the electrical strip which are disposed in the injector cups. The fuel rail was preferably molded in a manifold.

7 Claims, 2 Drawing Sheets

PLASTIC FUEL RAIL HAVING INTEGRATED ELECTRICAL WIRING

CROSS REFERENCE TO RELATED APPLICATION

The present application is related to commonly assigned U.S. patent application Ser. No. 08/398,196 filed on 2 Mar. 1995, entitled "Connector Injector with Tension and Electrical Connection to a Fuel Rail."

FIELD OF THE INVENTION

The present invention relates generally to a fuel injection system for an engine. More particularly, the present invention relates to a fuel rail having an electrical strip for electrically connecting an external connector to a fuel injector interface. The fuel injector interface is configured to mechanically and electrically couple the fuel injector to the fuel rail.

BACKGROUND OF THE INVENTION

Fuel systems often include one or more fuel injectors coupled to a metal fuel rail. The fuel injector receives fuel from the fuel rail at a fuel input and provides the fuel at a fuel output for use by an engine in response to an electrical signal. The fuel injector typically includes an external male electrical connector for receiving the electrical signal. The electrical signal is produced by an electronic control system and is provided across an external conductor (e.g., control wiring) to an external female connector which can be joined to the external male connector on the fuel injector.

Typically, fuel injectors have been physically (e.g., mechanically) coupled to the fuel rail by a metal clip. The metal clip mechanically secures the fuel input of the fuel injector to an injector cup of the fuel rail and ensures that the fuel injector is maintained in the injector cup when the fuel is pressurized. The fuel injectors are generally electrically coupled to the electronic control system via external connectors and conductors which are separate from the mechanical interface. The control wiring (e.g., external electrical conductors) generally must be fixed or harnessed to particular locations on the fuel rail or other engine components to prevent the control wiring from interfering with engine operation and to ensure the integrity of the electrical connections.

Heretofore, fuel injection systems have required electrical connection systems including external electrical conductors and external electrical connectors for electrically coupling the fuel injector to the control wiring. Such systems are disadvantageous because the electrical connectors and the fuel rail must be joined to the fuel injector in separate assembly steps. Also, electrical connection systems utilizing external connectors and conductors often require additional fastening hardware and bulky electrical connectors to provide a secure electrical connection. Further, the external connectors and conductors are generally expensive.

Thus, there is a need for an integrated wiring system for a fuel injection system which allows the fuel injector to be simultaneously mechanically mated to the full injector cup and electrically coupled to the electronic control system. There is also a need for a conductive strip integral the fuel rail which eliminates the need for external electrical connectors and conductors coupled to the fuel injectors.

SUMMARY OF THE INVENTION

The present invention relates to a fuel supply system including fuel injectors. The fuel supply system includes a fuel rail having an interior surface and an exterior surface, fuel injector attachments or interfaces coupled to the fuel rail, an electrical connector disposed on the exterior surface of the fuel rail, and an electrical connector strip having connector fingers. The injector attachments mechanically receive the fuel injectors. The electrical connector strip is adjacent the interior surface and electrically coupled to the electrical connector. The connector fingers are disposed in the fuel injector attachment for electric coupling to the fuel injectors.

The present invention further relates to a fuel injection system for use in an engine. The fuel injection system includes fuel injector means for providing fuel to the engine in response to a control signal, fuel rail means for providing the fuel, fuel injector attachment means for mechanically receiving the fuel injectors and providing the fuel from the fuel rail to the fuel injectors, input means for receiving the control signal, and electrical strip means for electrically coupling the input means to internal electrical connectors of the fuel injector means. The electrical strip means is coupled to the input means and at least partially disposed in the fuel injector attachment means. The electrical strip means provides the control signal from the input means to the fuel injector means and is at least partially disposed in the fuel rail means.

The present invention even further relates to a method of manufacturing a fuel rail having an integrated electrical strip. The fuel rail is for use in a fuel injection system, including fuel injectors, fuel injector interfaces, an external electrical connector disposed on the fuel rail, and an initially generally planar electrical strip having connector fingers. The fuel injector interfaces are adapted to be coupled to the fuel injectors. The method includes steps of inserting the electrical strip within the fuel rail, electrically coupling the electrical strip to the external electrical connector, and arranging the connector fingers to be disposed within the fuel injector interfaces. The fuel injectors are electrically coupled to the external connector via the electrical strip.

In one implementation of the present invention, a plastic fuel rail includes an integrated electrical strip for coupling an external electrical connector mounted on the fuel rail to fuel injectors mechanically coupled to fuel injector cups. The electrical strip is preferably comprised of a generally planar, non-conductive plastic member having at least one conductive line on both a top surface and a bottom surface. The electrical strip is generally flexible so that it may be easily installed within the fuel rail.

In another implementation of the present invention, connector fingers on the electrical strip are disposed within the injector cups to receive clip-like internal electrical connectors on the fuel injectors. The clip-like electrical connectors pinch the connector fingers. The fuel injectors are mechanically held to the fuel rail by a radial flange/snap engagement at the fuel injector interface.

The present invention advantageously integrates within the plastic fuel rail. The fuel rail may be situated within a manifold of the engine control wiring, e.g., the electrical coupling between an external electrical connector and the individual fuel injectors. The fuel injector may be both mechanically coupled to the fuel rail and electrically coupled to the electronic control system by a single upward mechanical motion.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
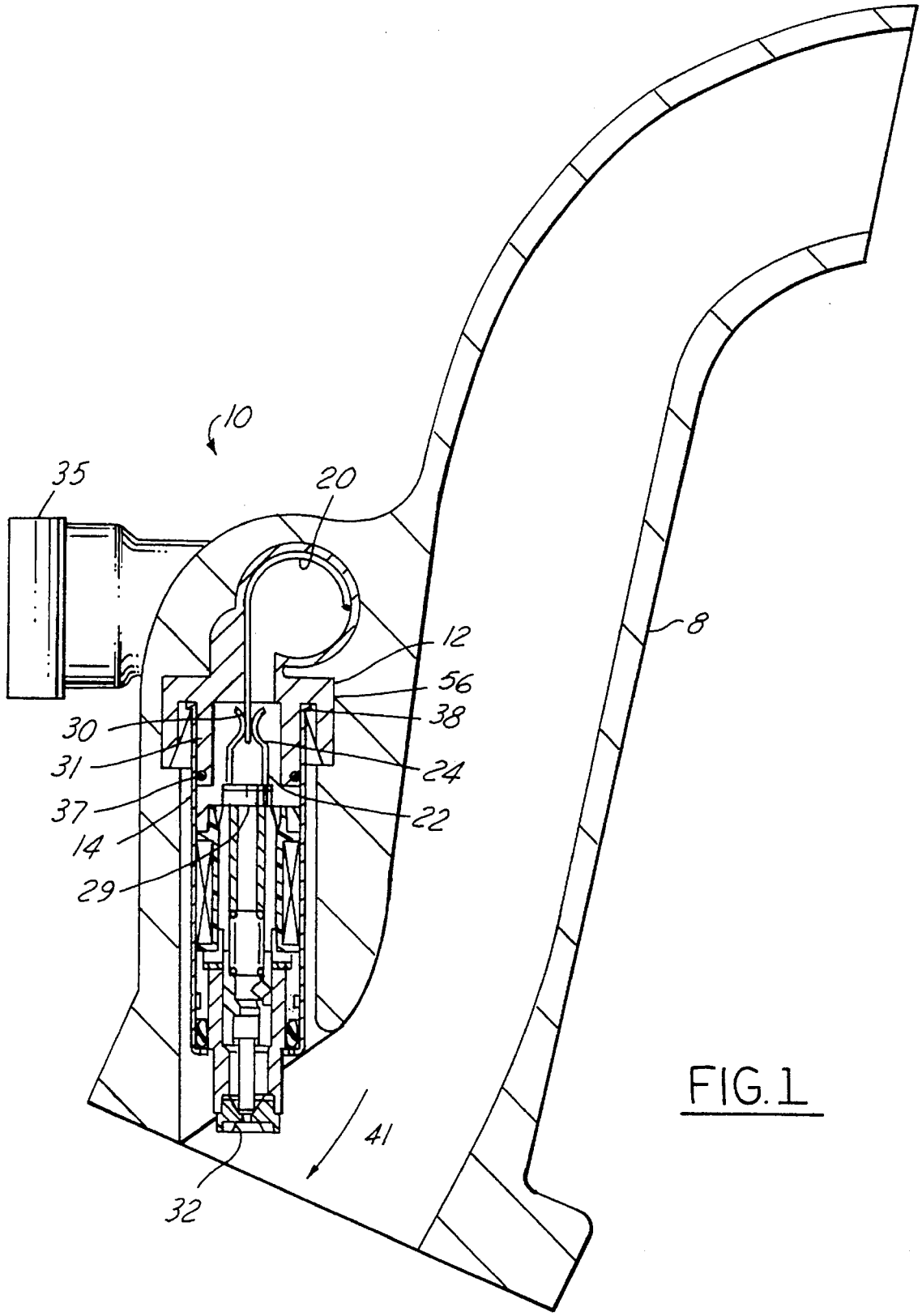
FIG. 1 is a cross sectional side view schematic drawing of a fuel supply system including a fuel rail mechanically and electrically engaged with fuel injectors in accordance with an exemplary embodiment of the present invention.

Referring generally to the schematic cross sectional side view drawing of FIG. 1, an engine (not shown) includes a manifold 8 housing a fuel supply system 10. The fuel supply system 10 generally includes a fuel rail 12 and a fuel injector 14. The fuel rail 12 can be fabricated from plastic and includes an electrical strip 20 serving as integrated wiring which is coupled to a clip-like electrical connector 22 on the injector 14. The electrical strip 20 is coupled to an external electrical connector 26 (FIG. 2) which is coupled to an electronic control system (not shown).

The fuel rail 12 is preferably overmolded into the manifold 8 to simplify the overall installation of the fuel supply system 10. The fuel rail 12 can be completely buried in the manifold 8 only requiring external interfaces such as a fuel input 35 for connection to a fuel line attachment and the external electrical connector 26. The connector 26 and the fuel input 35 are preferably sealed with respect to the manifold 8. The orientation of the fuel supply system 10 within the manifold 8 inherently provides a double wall around fuel passages, thereby allowing each wall to be thinner. Preferably, the fuel rail 12 is made from a material such as polyphenylene sulfide compound (PPS).

Figure 4:
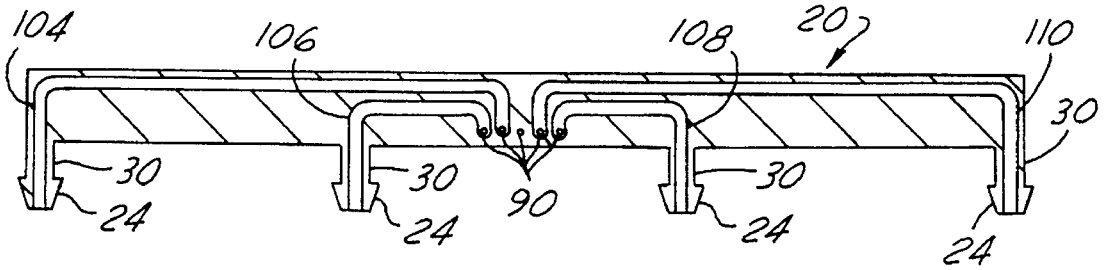
FIG. 4 is a top view schematic drawing of an electrical strip for use in the fuel rail illustrated in FIG. 2 in accordance with an exemplary embodiment of the present invention.

The electrical strip 20 includes connector fingers such as a connector finger 30 having a trapezoidal termination 24 (see FIG. 4). The electrical strip 20 is coupled to the external electrical connector 26 (FIG. 2) and a connector finger 30. The connector fingers 30 are disposed within an injector cup 31 which is disposed within an injector attachment 56 (see FIG. 2). The fuel rail 12 mechanically receives a fuel injector 14 at the injector cup 31. The fuel rail 12 receives fuel from a fuel line other fuel source (not shown) at the fuel input 35 and provides fuel to the fuel injector 14 at the injector cup 31.

The fuel injector 14 preferably protrudes into an air stream 41 of the manifold 8 and includes a fuel input 29 which receives fuel from the injector cup 31 of the fuel rail 12. The fuel injector 14 provides the fuel from its fuel input 29 to a nozzle or fuel output 32 for use by the manifold 8 in response to one or more electrical signals received at the clip-like connector 22. The fuel injector 14 is slidably attached to the fuel injector attachment 56 at its fuel input 29, thereby permitting insertion, removal and replacement of the injector 14 relative to the fuel rail 12.

The fuel injector 14 also includes a radial flange 38 mechanically configured to slide into and engage a snap interface 21 on the fuel injector attachment 56. The snap interface 21 locks the fuel injector 14 to the fuel rail 12 and ensures a sealed mechanical connection about the injector cup 31. The injector cup 31 preferably includes an O-ring 37 for preventing fuel from leaking at the interface of the injector 14 and the fuel rail 12.

The fuel supply system 10 is shown with the fuel rail 12 mated with the fuel injector 14. In accordance with this exemplary embodiment, the injector 14 is mechanically coupled to the fuel rail 12 by an upward physical motion joining the snap interface 21 with the radial flange 38. The snap interface 21 and the radial flange 38 resist downward forces due to the pressurized fuel in the fuel rail 12. Preferably, the manifold 8 is manufactured in a lost core molding process to maintain appropriate tolerances so that the manifold 8 can seal the snap interface 21. Alternatively, a separate sleeve (not shown) may be utilized to cover the snap interface 21.

The electrical connector 22 is simultaneously electrically coupled to or connected to the connector finger 30 of the electrical strip 20 by the same motion that mechanically couples the fuel injector 14 to the fuel rail 12. When the connector finger 30 engages (e.g., is coupled to) the clip-like connector 22, the injector 14 is electrically coupled to receive one or more electrical signals from the electronic control system (not shown) via the external connector 26 and the electrical strip 20. The clip-like connector 22 preferably slides up the connector finger 30 at the trapezoidal termination 24. The clip-like connectors 22 are preferably held in place by mechanical forces due to the clip-like construction of the connectors 22 which squeeze the connector finger 30. Therefore, the orientation of the fuel rail 12 and the injector 14 advantageously allows the fuel rail 12 to be electrically and mechanically mated to the fuel injector 14 simultaneously when the snap interface 21 engages the radial flange 38.

Figure 2:
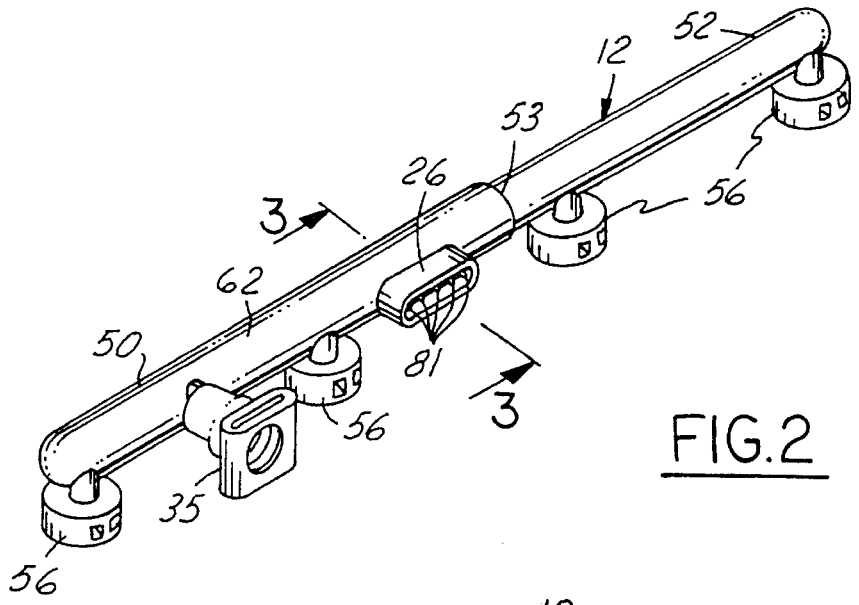
FIG. 2 is an isometric schematic drawing of the fuel rail illustrated in FIG. 1 showing fuel injector interfaces and an external electrical connector.

With reference to FIG. 2, the fuel rail 12 is preferably comprised of a unitary plastic molded piece 50 and a unitary plastic molded piece 52. The pieces 50 and 52 are preferably joined at a juncture 53 including an 0-ring seal (not shown). The fuel rail 12 also includes the external connector 26 integrally electrically coupled to each of the fuel injector attachments 56 via the electrical strip 20.

Each fuel injector attachment 56 includes its own injector cup 31 (FIG. 1). The external connector 26 is preferably an integrally formed connector on an outside surface 62 of the fuel rail 12 configured for connection to a male connector (not shown) coupled to the electronic control system (not shown). The external connector 26 is situated on the surface 62 of the fuel rail 12 for access to a male connector (not shown). Preferably, the external connector 26 includes five pins such as pins 81 (e.g., one more pin than the number of injectors such as the fuel injector 14). Additionally, the fuel rail 12 is coupled to the fuel input 35 which is configured for receiving the fuel line of the engine (not shown).

Figure 3:
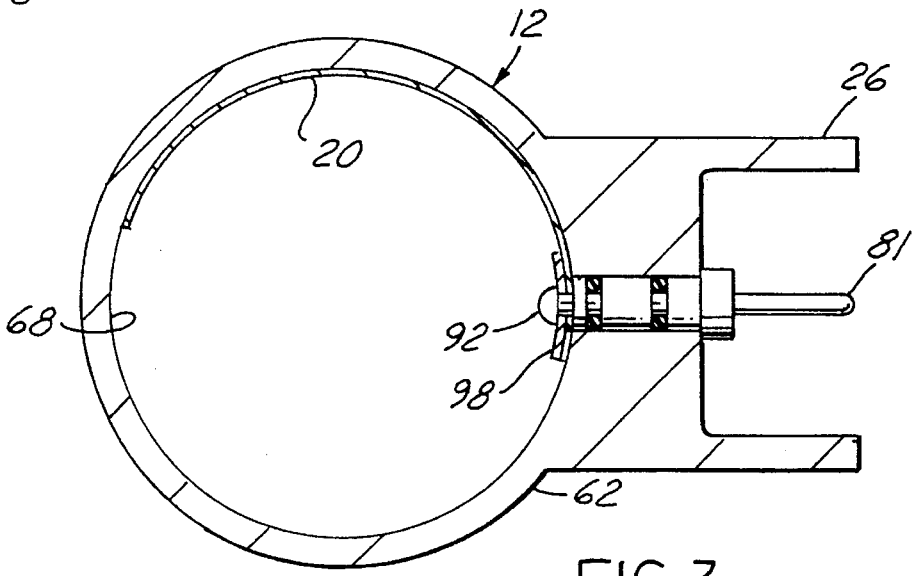
FIG. 3 is a detailed cross sectional view of the fuel rail illustrated in FIG. 2 a long line 3—3.

With reference to FIG. 3, a cross sectional view of the fuel rail 12 includes the external connector 26 and the electrical strip 20. The electrical strip 20 is disposed in the fuel rail 12 adjacent an inside surface 68 so that the flow of fuel in the fuel rail 12 is not significantly affected. The electrical strip 20 is secured to the fuel rail 12 through an aperture 90 by a head 92 of the pin 81. The pin 81 which is disposed through a washer 98 and 0-ring seals 95 is electrically connected to the electrical strip 20 via the head 92. Alternatively, the pin 81 may be brazed to the electrical strip 20. The aperture 90 is preferably aligned with an aperture 99 in the fuel rail 12.

With reference to FIG. 4, a top view of the electrical strip 20 shows a generally rectangular, initially planar plastic member having a conductive pattern on a top or first surface 102. The conductive pattern includes conductive lines 104, 106, 108 and 110, each separately extending from one of the connector fingers 30 to one of the apertures 90. Additionally, the electrical strip 20 includes a conductive line on a back or second surface (not shown) extending from the middle hole of the apertures 90 to each of the connector fingers 30. The conductive lines 104, 106, 108 and 110 provide individual control signals for each fuel injector 14 in the fuel supply system 10. Each conductive line is coupled to a respective pin 81 via the head 92 at one of the apertures 90. The conductive pattern may be formed of a metallic surface.

Also, the conductive line on the back or second surface of the electrical strip 20 is coupled to the middle aperture of the apertures 90 and provides a ground signal to each of the connector fingers 30. The clip-like connectors 22 engage the conductive lines 104, 106, 108 and 110 and the conductive line on the back surface of the electrical strip 20 to provide a secure electrical connection between the strip 20 and the fuel injector 14. The trapezoidal terminations 24 provide a larger surface area for the clip-like connectors 22 to engage the connector fingers 30 and prevent the connector fingers 30 from being pushed out of the injector cup 31.

The manufacturing of the fuel rail 12 including the integrated electrical strip 20 is discussed below with reference to FIGS. 1–4. The fuel rail 12 is separated; into the molded piece 50 and the molded piece 52. The electrical strip 20 is coiled and inserted into the piece 50 and manipulated so that the apertures 90 in the electrical strip 20 are aligned with similarly situated apertures 99 in the fuel rail 12 proximate the external electrical connector 26. A pin 81 is riveted through each of the apertures 90 and 99. The electrical strip is held to the inside surface 68 of the fuel rail 12 by the head 92 of the pin 81 and a washer 93. Alternatively, the pin 81 may be brazed to the electrical strip 20.

After the electrical strip 20 is inserted into the molded piece 50, and the electrical strip 20 is uncoiled and manipulated so that the connector fingers 30 extend into the injector cups 31 of the fuel injector attachments 56. Next, the electrical strip 20 is coiled and inserted into the molded piece 52. The electrical strip 20 is then uncoiled and manipulated so that the connector fingers 30 extend in the injector cups 31 of each of the injector attachments 56 on the molded piece 52. The molded pieces 50 and 52 are joined at the juncture 53 and sealed so that fuel does not leak as fuel flows from the fuel input 35 to the injector cups 31 and the injector attachments 56 on both of the molded pieces 50 and 52. The trapezoidal terminations 24 are preferably configured to prevent the connector fingers 30 from being pushed back into the injector cups 31 once the connector fingers 30 are uncoiled into the injector cups 31.

Other fuel injectors 14, fuel rails 12, and electrical strips 20 may be utilized in the fuel supply system 10 depending on upon the requirements of the particular application. For example, a fuel rail 12 for an eight-cylinder engine may include eight separate fuel injectors 14 and eight separate injector cups 31. Alternatively, the electrical strip 20 may be manufactured from various materials suitable for use in the fuel rail 12. Additionally, the fuel rail 12 and the fuel injector 14 may include fittings, grooves, keys, key seats, or channels for providing a stable interconnecting or coupling scheme in the fuel supply system 10.

It is understood that, while the detailed description and drawing shows specific examples of the present invention, they are for the purposes of illustration only. The present invention is not limited to the precise details and conditions disclosed. For example, the clip-like electrical connector 22 is shown on the fuel injector 14 and a female electrical connector is shown on the fuel rail 12, other types of electrical interface between the fuel injectors 14 and the fuel rail 12 may be utilized. Further still, although the fuel rail 12 and the electric strip 20 are preferably made of plastics, other materials may be suitable for use in the fuel supply system 10. Various changes can be made to the details disclosed without departing from the spirit of the invention which is defined by the following claims.

What is claimed is:

1. A fuel supply system for use with a plurality of fuel injectors, the fuel supply system comprising:

a fuel rail having an interior surface and an exterior surface;

a plurality of fuel injector attachments coupled to said fuel rail for mechanically receiving the fuel injectors;

an electrical connector disposed on said exterior surface of said fuel rail; and an electrical connector strip comprised of a flat non-conductive strip having conductive surfaces having a plurality of connector fingers, said electrical connector strip adjacent said interior surface of said fuel rail and electrically coupled to said electrical connector, said connector fingers being disposed in said fuel injector attachments for electrical coupling with the fuel injectors, said electrical connector is coupled to said electrical connector strip via a rivet disposed through an O-ring, the O-ring being disposed between said interior and exterior surfaces.

2. The fuel supply system of claim 1 wherein said electrical connector strip has a first surface, a second surface, a first conductive line disposed on said first starface and a second conductive line disposed on said second surface.

3. The fuel supply system of claim 2 wherein said second conductive line is electrically coupled to each fuel injector.

4. The fuel supply system of claim 3 wherein said second conductive line includes a plurality of separate control lines, wherein each of said separate control lines is coupled to one of the fuel injectors.

5. A method of manufacturing a fuel rail having an integral electrical strip, the fuel rail for use in a fuel injector system, the fuel injector system including a plurality of fuel injectors, a plurality of fuel injector interfaces coupled to the fuel rail, the fuel injector interfaces adapted to be coupled to the fuel injectors and to provide fuel from the fuel rail to the fuel injector, an external electrical connector disposed on the fuel rail, and an initially generally planar electrical strip having connector fingers, the method comprising steps of:

inserting the electrical strip within the fuel rail:

electrically coupling the electrical strip to the external electrical connector including aligning an aperture in the electrical strip with an aperture in the fuel rail and driving a conductive rivet through the apertures; and arranging the connector fingers to be disposed within the fuel injector interfaces, for electrically coupling the fuel injectors to the external electrical connector via the electrical strip.

6. The method of claim 5 further comprising:

forming the fuel rail in a plurality pieces to allow the insertion of the electrical strip; and joining the pieces to form the fuel rail.

7. The method of claim 6 wherein the joining step includes placing an O-ring between the pieces.

* * * * *